US006588065B1

(12) United States Patent
Tucker, III

(10) Patent No.: US 6,588,065 B1
(45) Date of Patent: Jul. 8, 2003

(54) ELECTRIC TELESCOPING POLE

(76) Inventor: John C. Tucker, III, 218 SW. 21st Rd., Miami, FL (US) 33129

( * ) Notice: Subject to any disclaimer, the term of this patent is extended or adjusted under 35 U.S.C. 154(b) by 0 days.

(21) Appl. No.: 09/965,716

(22) Filed: Sep. 27, 2001

(51) Int. Cl.[7] ..... A45C 13/22

(52) U.S. Cl. ..... 16/429; 16/426; 16/427; 16/429; 343/883

(58) Field of Search ..... 16/426, 427, 428, 16/429; 52/632; 343/883, 901, 880, 890

(56) References Cited

U.S. PATENT DOCUMENTS

| | | | | | |
|---|---|---|---|---|---|
| 2,562,679 | A | * | 7/1951 | Ort et al. | 248/161 |
| 2,822,067 | A | * | 2/1958 | Price et al. | 403/109.7 |
| 3,317,997 | A | * | 5/1967 | Hedstrom et al. | 16/429 |
| 3,384,408 | A | * | 5/1968 | Furzey et al. | 294/65.5 |
| 3,722,154 | A | * | 3/1973 | Sakamoto et al. | 212/349 |
| 4,078,589 | A | * | 3/1978 | Miller | 310/50 |
| 4,258,825 | A | | 3/1981 | Collins | |
| 4,385,849 | A | | 5/1983 | Crain | |
| 4,539,927 | A | | 9/1985 | Foresman | |
| 4,568,808 | A | * | 2/1986 | Thuries et al. | 200/48 V |
| 4,793,197 | A | * | 12/1988 | Petrovsky | 248/161 |
| 4,911,039 | A | | 3/1990 | Lubbock et al. | |
| 4,924,573 | A | * | 5/1990 | Huddleston et al. | 30/272.1 |
| 5,084,975 | A | * | 2/1992 | Melter | 30/245 |
| 5,101,215 | A | * | 3/1992 | Creaser, Jr. | 343/883 |
| 5,333,422 | A | | 8/1994 | Warren et al. | |
| 5,353,461 | A | * | 10/1994 | Enriquez | 15/104.095 |
| D354,554 | S | | 1/1995 | Newman, Sr. et al. | |
| 6,002,378 | A | * | 12/1999 | Harada et al. | |

* cited by examiner

*Primary Examiner*—Gary Estremsky
*Assistant Examiner*—Mark Williams

(57) ABSTRACT

An electric telescoping pole for allowing the user to quickly and effortlessly alter the length of a pole used for coupling tools to. The electric telescoping pole includes a pair of tubular members, the first member telescopically receiving the second member, an electric drive assembly housed in the base of the first member, which, by way of a switching mechanism, electrically controls the pole's length.

14 Claims, 2 Drawing Sheets

ELECTRIC TELESCOPING POLE

BACKGROUND OF THE INVENTION

1. Field of the Invention

The present invention relates to telescoping poles and more particularly pertains to a new electric telescoping pole for allowing the user to quickly and effortlessly alter the length of a pole used for coupling tools to.

2. Description of the Prior Art

The use of telescoping poles is known in the prior-art. More specifically, telescoping poles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,385,849 4,258, 825; 4,539,927; 4,911,039; 5,333,4722; and Des. 354,554.

While these devices fulfill their respective, particular objectives and requirements, the aforementioned patents do not disclose a new electric telescoping pole. The inventive device includes a pair of tubular members, the first member telescopically receiving the second member, an electric drive assembly housed in the base of the first member, which, by way of a switching mechanism, electrically controls the pole's length.

In these respects, the electric telescoping pole according to the present invention substantially departs from the conventional concepts and designs of the prior art, and in so doing provides an apparatus primarily developed for the purpose of allowing the user to quickly and effortlessly alter the length of a pole used for coupling tools to.

SUMMARY OF THE INVENTION

In view of the foregoing disadvantages inherent in the known types of telescoping poles now present in the prior art, the present invention provides a new electric telescoping pole construction wherein the same can be utilized for allowing the user to quickly and effortlessly alter the length of a pole used for coupling tools to.

The general purpose of the present invention, which will be described subsequently in greater detail, is to provide a new electric telescoping pole apparatus and method which has many of the advantages of the telescoping poles mentioned heretofore and many novel features that result in a new electric telescoping pole which is not anticipated, rendered obvious, suggested, or even implied by any of the prior art telescoping poles, either alone or in any combination thereof.

To attain this, the present invention generally comprises a pair of tubular members, the first member telescopically receiving the second member, an electric drive assembly housed in the base of the first member, which, by way of a switching mechanism, electrically controls the pole's length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electric telescoping pole apparatus and method which has many of the advantages of the telescoping poles mentioned heretofore and many novel features that result in a new electric telescoping pole which is not anticipated, rendered obvious, suggested, or even implied by any of the prior art telescoping poles, either alone or in any combination thereof.

It is another object of the present invention to provide a new electric telescoping pole which may be easily and efficiently manufactured and marketed.

It is a further object of the present invention to provide a new electric telescoping pole which is of a durable and reliable construction.

An even further object of the present invention is to provide a new electric telescoping pole which is susceptible of a low cost of manufacture with regard to both materials and labor, and which accordingly is then susceptible of low prices of sale to the consuming public, thereby making such electric telescoping pole economically available to the buying public.

Still yet another object of the present invention is to provide a new electric telescoping pole which provides in the apparatuses and methods of the prior art some of the advantages thereof, while simultaneously overcoming some of the disadvantages normally associated therewith.

Still another object of the present invention is to provide a new electric telescoping pole for allowing the user to quickly and effortlessly alter the length of a pole used for coupling tools to.

Yet another object of the present invention is to provide a new electric telescoping pole which includes a pair of tubular members, the first member telescopically receiving the second member, an electric drive assembly housed in the base of the first member, which, by way of a switching mechanism, electrically controls the pole's length.

Still yet another object of the present invention is to provide a new electric telescoping pole that allows the user to reach high work areas when extended, then quickly retract the pole for the purpose of reaching the attached tool, for example a paint roller, thereby increasing efficiency.

Even still another object of the present invention is to provide a new electric telescoping pole that can be used with a variety of different tools making it very universal in nature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
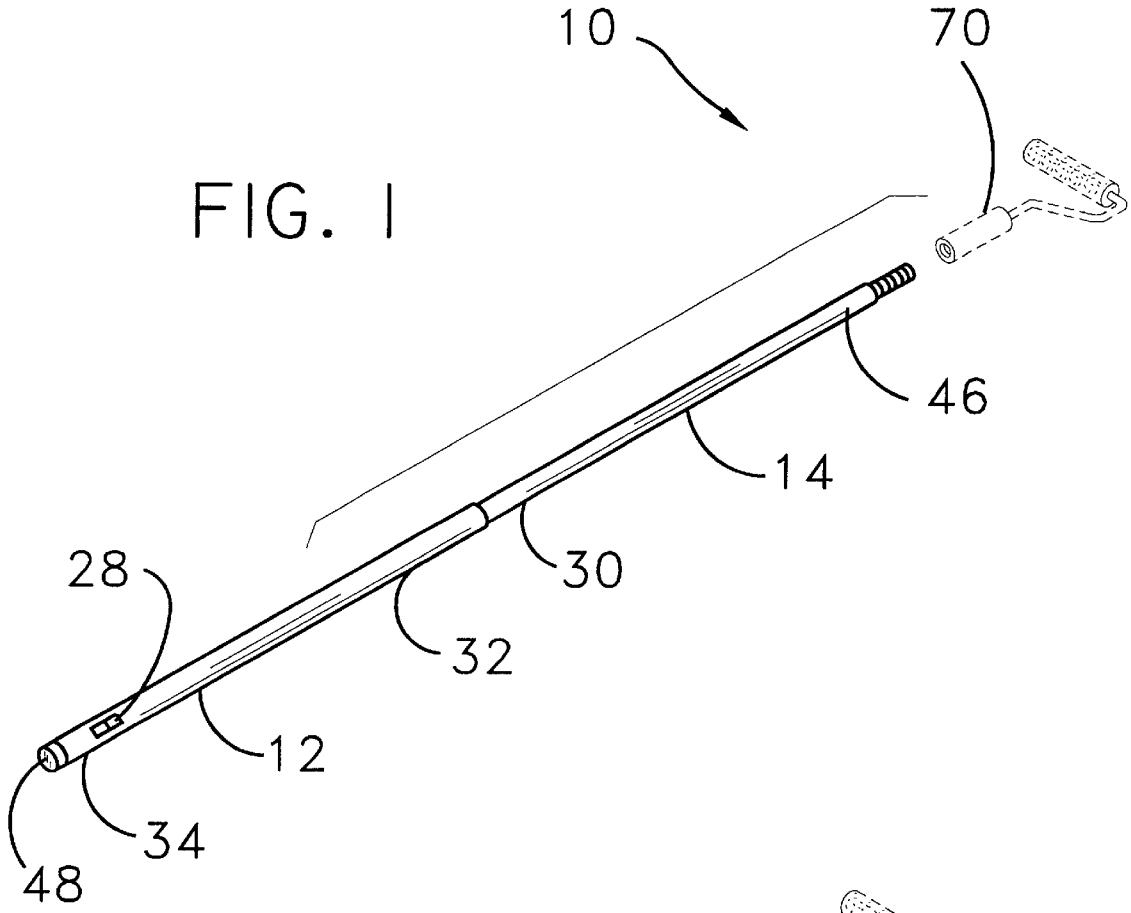
FIG. 1 is a schematic perspective view of a new electric telescoping pole in the extended position according to the present invention.
Figure 2:
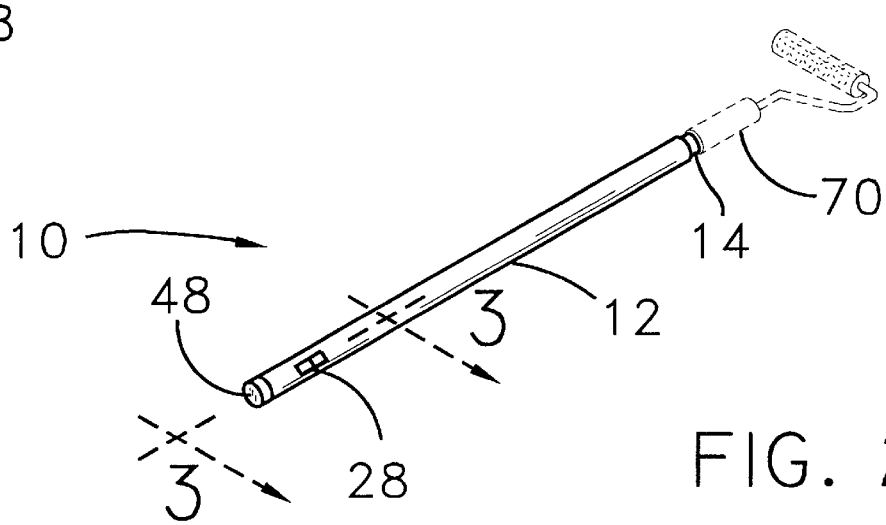
FIG. 2 is a schematic perspective view of the present invention in the retracted position.
Figure 3:
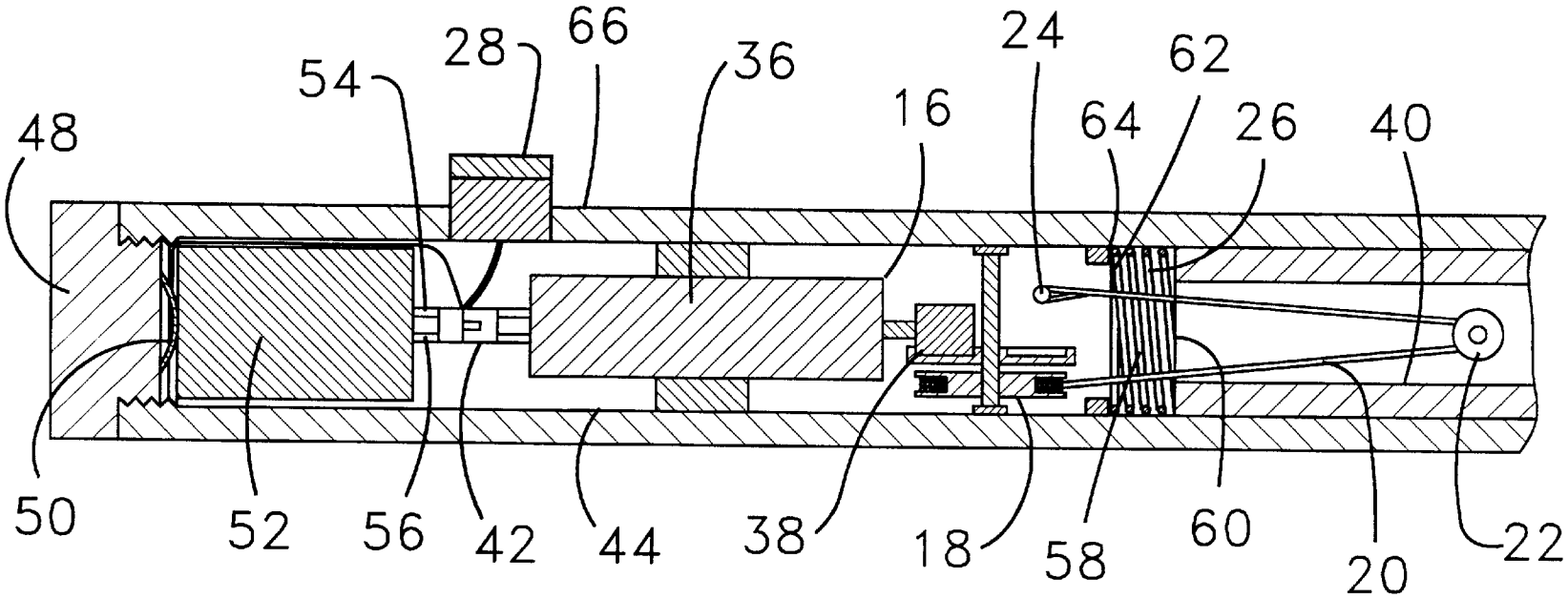
FIG. 3 is a schematic cross-sectional view of the drive assembly of the present invention.

With reference now to the drawings, and in particular to FIGS. 1 through 3 thereof, a new electric telescoping pole embodying the principles and concepts of the present invention and generally designated by the reference numeral 10 will be described.

As best illustrated in FIGS. 1 through 3, the electric telescoping pole 10 generally comprises a pair of tubular members. The first tubular member 12 telescopically receives the second tubular member 14.

A drive assembly 16 rotatably controls a cable spool 18. The cable spool 18 includes a control cable 20. A first end of the control cable 20 is coupled to and wrapped about the cable spool 18 for rotatably extending and retracting the control cable 20.

The control cable 20 engages a pulley member 22 such that when the cable spool 18 rotatably retracts the control cable 20, the pulley member 22 is biased towards the distal end of the control cable 20 thereby retracting the second tubular member 14 into the first tubular member 12.

A biasing member 26 for biasing the second tubular member 14 to an extended position when the control cable 20 is extended.

The first tubular member 12 includes a switching mechanism 28 for electrically biasing the drive assembly 16 multi-directionally such that an operator can selectively extend and retract the first tubular member 12 with respect to the second tubular member 14.

The tubular members are of substantially equal lengths and include respective proximal and distal ends. The proximal end of the second tubular member 30 is received in the distal end of the first tubular member 32.

The first tubular member 12 includes an electrical drive assembly 16 housed in the proximal end of the first tubular member 34.

The drive assembly 16 includes a drive motor 36 and a plurality of gear members 38 for engaging the cable spool 18.

The drive motor 36 has an outside diameter substantially equal to the inside diameter of the first tubular member 12, and is fixedly coupled to an inside surface of the first tubular member 40.

The drive motor 36 is coupled to a main wiring harness 42.

The pulley member 22 is fixedly mounted to an inside surface of the second tubular member 44 proximate the distal end of the second tubular member 46.

The first tubular member 12 includes an end cap 48 that is selectively couplable to the distal end of the first tubular member 32.

The end cap 48 includes an electrical contact surface 50 for contacting a battery 52 when the end cap 48 is coupled to the first tubular member 12. The surface has a connecting means for connecting a first battery terminal 54 to the main wiring harness 42.

The battery 52 has an outside diameter approximately equal to an inside diameter of the first tubular member 12, and a connecting means for connecting a second battery terminal 56 to the main wiring harness 42.

The control cable 20 is positioned substantially parallel to a longitudinal axis of the first and second tubular members 12, 14. The distal end of the control cable 24 is fixedly mounted to an inside surface of the first tubular member 40 proximate the cable spool 18.

The length of the control cable 20 is extendable and retractable by rotation of the cable spool 18.

The biasing member 26 is a spring 58, which includes respective distal and proximal ends.

The spring 58 has an outer diameter substantially equal to the inner diameter of the first tubular member 12.

The distal end of the spring 60 contacts the proximal end of the second tubular member 30 such that when the second tubular member 14 is fully retracted the spring 58 is fully compressed.

The proximal end of the spring 62 abuts a shoulder surface 64. The shoulder surface 64 is fixedly coupled to the inside surface of the first tubular member 40 proximate the distal end of the control cable 24.

The switching mechanism 28 includes a connecting means for connecting the drive assembly 16 to the main wiring harness 42. The switching mechanism 28 is coupled to an outer surface 66 of the first tubular member 12 proximate the proximal end of the second tubular member 30 for allowing the user access to the switching mechanism 28.

The distal end of the second tubular member 46 includes a coupling means for selectively coupling the second tubular member 14 to a tool or other similar apparatus such as a paint roller 70.

Each of the tubular members is produced from one material selected from a group of materials consisting of plastic, fiberglass, steel, or aluminum.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electric telescoping pole comprising:

a pair of tubular members, a first of said pair of tubular members telescopically receiving a second of said pair of tubular members;

a drive assembly for rotatably controlling a cable spool, said cable spool including a control cable, a first end of said control cable being coupled to and wrapped about said cable spool for rotatably extending and retracting said control cable;

said control cable engaging a pulley member such that when said cable spool rotatably retracts said control cable, said pulley is biased towards said distal end of control cable thereby retracting said second tubular member into said first tubular member;

a biasing member for biasing said second tubular member to an extended position when said control cable is extended; and said first tubular member including an electrical switching mechanism for biasing said drive assembly multi-directionally such that an operator can selectively extend and retract said first tubular member with respect to said second tubular member.

2. The electric telescoping pole as set forth in claim 1, further comprising:

said tubular members being of substantially equal lengths and having respective proximal and distal ends, said proximal end of said second tubular member being received in said distal end of said first tubular member.

3. The electric telescoping pole as set forth in claim 1, further comprising:

said first tubular member having an electrical drive assembly, said drive assembly being housed in said proximal end of said first tubular member; and said drive assembly including a drive motor and a plurality of gear members for engaging said cable spool.

4. The electric telescoping pole as set forth in claim 3, further comprising:

said drive motor having an outside diameter substantially equal to the inside diameter of said first tubular member;

said drive motor being fixedly coupled to an inside surface of said first tubular member; and said drive motor being couplable to a main wiring harness.

5. The electric telescoping pole as set forth in claim 1, further comprising:

said pulley member being fixedly mounted to an inside surface of said second tubular member proximate said distal end of said second tubular member.

6. The electric telescoping pole as set forth in claim 1, further comprising:

said first tubular member having an end cap, said end cap being selectively couplable to said distal end of said first tubular member;

said end cap including an electrical contact surface for contacting a battery when said end cap is coupled to said first tubular member; and said surface including a connecting means for connecting a first battery terminal to a main wiring harness.

7. The electric telescoping pole as set forth in claim 6, further comprising:

said battery having an outside diameter approximately equal to an inside diameter of said first tubular member, and a connecting means for connecting a second battery terminal to said wiring harness.

8. The electric telescoping pole as set forth in claim 1, further comprising:

said control cable being positioned substantially parallel to a longitudinal axis of said first and second tubular members, said distal end of said cable being fixedly mounted to an inside surface of said first tubular member proximate said cable spool; and said length of said control cable being extendable and retractable by rotation of said cable spool.

9. The electric telescoping pole as set forth in claim 1, further comprising:

said biasing member being a spring;

said spring having respective distal and proximal ends;

said spring having an outer diameter substantially equal to the inner diameter of said first tubular member; and said distal end of said spring contacting said proximal end of said second tubular member such that when said second tubular member is fully retracted said spring is fully compressed.

10. The electric telescoping pole as set forth in claim 9, further comprising:

said proximal end of said spring abutting a shoulder surface, said shoulder surface being fixedly coupled to the inside surface of said first tubular member proximate said distal end of said control cable.

11. The electric telescoping pole as set forth in claim 1, further comprising:

said switching mechanism including a connecting means for connecting said drive assembly to a main wiring harness;

said switching mechanism being coupled to an outer surface of said first tubular member proximate said proximal end of said second tubular member for allowing the user access to said switching mechanism.

12. The electric telescoping pole as set forth in claim 1, further comprising:

said distal end of said second tubular member having a coupling means for selectively coupling said second tubular member to a tool.

13. The electric telescoping pole as set forth in claim 1, further comprising:

each of said tubular members being produced from one material selected from a group of materials consisting of plastic, fiberglass, steel, and aluminum.

14. An electric telescoping pole comprising:

a pair of tubular members, a first of said pair of tubular members telescopically receiving a second of said pair of tubular members;

a drive assembly for rotatably controlling a cable spool, said cable spool including a control cable, a first end of said control cable being coupled to and wrapped about said cable spool for rotatably extending and retracting said control cable;

said control cable engaging a pulley member such that when said cable spool rotatably retracts said control cable, said pulley is biased towards said distal end of control cable thereby retracting said second tubular member into said first tubular member;

a biasing member for biasing said second tubular member to an extended position when said control cable is extended;

said first tubular member including an electrical switching mechanism for biasing said drive assembly multi-directionally such that an operator can selectively extend and retract said first tubular member with respect Lo said second tubular member;

said tubular members being of substantially equal lengths and having respective proximal and distal ends, said proximal end of said second tubular member being received in said distal end of said first tubular member;

said first tubular member having an electrical drive assembly, said drive assembly being housed in said proximal end of said first tubular member;

said drive assembly including a drive motor and a plurality of gear members for engaging said cable spool;

said drive motor having an outside diameter substantially equal to the inside diameter of said first tubular member;

said drive motor being fixedly coupled to an inside surface of said first tubular member;

said drive motor being couplable to a main wiring harness;

said pulley member being fixedly mounted to an inside surface of said second tubular member proximate said distal end of said second tubular member;

said first tubular member having an end cap, said end cap being selectively couplable to said distal end of said first tubular member;

said end cap including an electrical contact surface for contacting a battery when said end cap is coupled to said first tubular member;

said surface including a connecting means for connecting a first battery terminal to said main wiring harness said battery having an outside diameter approximately equal to an inside diameter of said first tubular member, and a connecting means for connecting a second battery terminal to said wiring harness;

said control cable having positioned substantially parallel to a longitudinal axis of said first and second tubular members, said distal end of said cable being fixedly mounted to an inside surface of said first tubular member proximate said cable spool;

said length of said control cable being extendable and retractable by rotation of said cable spool;

said biasing member being a spring;

said spring having respective distal and proximal ends;

said spring having an outer diameter substantially equal to the inner diameter of said first tubular member;

said distal end of said spring contacting said proximal end of said second tubular member such that when said second tubular member is fully retracted said spring is fully compressed;

said proximal end of said spring abutting a shoulder surface, said shoulder surface being fixedly coupled to the inside surface of said first tubular member proximate said distal end of said control cable;

said switching mechanism including a connecting means for connecting said drive assembly to said main wiring harness;

said switching mechanism being coupled to an outer surface of said first tubular member proximate said proximal end of said second tubular member for allowing the user access to said switching mechanism;

said distal end of said second tubular member having a coupling means for selectively coupling said second tubular member to a tool; and each of said tubular members being produced from one material selected from a group of materials consisting of plastic, fiberglass, steel, and aluminum.

* * * * *